US005703029A

United States Patent [19]

Crass et al.

[11] Patent Number: 5,703,029

[45] Date of Patent: Dec. 30, 1997

[54] CAR DRY-BRIGHT COMPOSITION

[75] Inventors: Gerhard Crass, Friedberg; Erich Gatter, Kastl, both of Germany

[73] Assignee: Hoechst Aktiengesellschaft, Germany

[21] Appl. No.: 520,012

[22] Filed: Aug. 28, 1995

[30] Foreign Application Priority Data

Aug. 30, 1994 [DE] Germany ..... 44 30 721.7

[51] Int. Cl.[6] ..... C11D 1/62; C11D 1/835

[52] U.S. Cl. ..... 510/242; 510/504; 510/506

[58] Field of Search ..... 252/8.8, 8.9, 8.6, 252/174.21, 174.22, 544, 547; 510/504, 499, 505, 506, 241, 242

[56] References Cited

U.S. PATENT DOCUMENTS

| | | | |
|---|---|---|---|
| 3,551,168 | 12/1970 | Atherton | 106/8 |
| 3,658,718 | 4/1972 | Clumpner | 252/357 |
| 4,767,547 | 8/1988 | Straathof et al. | 252/8.8 |
| 4,830,771 | 5/1989 | Ruback et al. | 252/8.8 |
| 4,963,274 | 10/1990 | Ruback et al. | 252/8.75 |
| 5,066,414 | 11/1991 | Chang | 252/8.8 |
| 5,288,847 | 2/1994 | Harmalker et al. | 252/8.8 |
| 5,296,622 | 3/1994 | Uphues et al. | 554/103 |
| 5,437,801 | 8/1995 | Lüders et al. | 252/8.8 |

FOREIGN PATENT DOCUMENTS

| | | |
|---|---|---|
| 0003775 | 9/1979 | European Pat. Off. . |
| 0173376 | 3/1986 | European Pat. Off. . |
| 0264634 | 4/1990 | European Pat. Off. . |
| 0421146 | 4/1991 | European Pat. Off. . |
| 30 32 220 | 4/1982 | Germany . |
| 4015849 | 11/1991 | Germany . |
| 4125025 | 2/1993 | Germany . |
| 4232448 | 3/1994 | Germany . |
| WO91/01295 | 2/1991 | WIPO . |

*Primary Examiner*—Douglas J. McGinty
*Assistant Examiner*—John R. Hardee
*Attorney, Agent, or Firm*—Connolly and Hutz

[57] ABSTRACT

The present invention relates to a car dry-bright composition comprising from 1 to 30% by weight of quaternary ammonium compounds of the formula

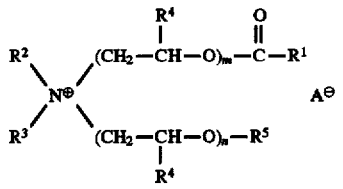

in which $R^1$ is independently at each occurrence $C_6$–$C_{22}$-alkyl or $C_6$–$C_{22}$-alkenyl, m and n independently of one another are a number from 1 to 6, $R^2$ is $C_1$–$C_4$-alkyl, $R^4$ is hydrogen or $C_1$–$C_4$-alkyl, $R^5$ is hydrogen or a group of the formula $C(O)R^1$, $R^3$ is $C_1$–$C_4$-alkyl or a group of the formula

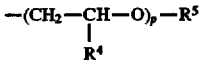

in which $R^4$ and $R^5$ are as defined above and p is a number from 1 to 6, and $A^{\ominus}$ is an anion, and water and, if desired, further auxiliaries corresponding to the balance to 100% by weight.

1 Claim, No Drawings

CAR DRY-BRIGHT COMPOSITION

The present invention relates to a water-dilutable car dry-bright composition which has a strong hydrophobicizing action and is used in highly diluted form in washing and rinsing liquids at carwash installations. During washing of the automobile, the use of surface-active agents in the washing water results in the formation on the vehicle surface of a closed, firmly adhering film of water. This film has to be removed in order to avoid the formation of blotches or streaks owing to the salts and other impurities in the water. To achieve this, surface-active quaternary ammonium compounds are added to the water in the secondary rinsing phase. Because of the adsorption of the cationic surfactant on the paint surface, the film of water is opened up, and the water deposits in the form of drops on the paint surface. The drops of water can then easily be removed by means of a fan.

EP-A-0 003 775 discloses car dry-bright agents consisting of from 30 to 90% by weight, preferably from 60 to 70% by weight, of a quaternary ammonium compound of the formula

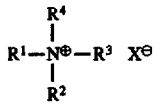

in which $R^1$ and $R^2$ are $C_8$–$C_{20}$-alkyl or $C_8$–$C_{20}$-alkenyl, $R^3$ and $R^4$ are hydroxyalkyl and X is an anion, and from 15 to 70% by weight, preferably from 15 to 40% by weight, of an alkanol, alkenol or $C_8$–$C_{20}$-carboxylic acid $C_1$–$C_4$-alkyl ester.

EP-A-0 264 634 discloses a car dry-bright composition which essentially consists of from 5 to 90% by weight, preferably from 8 to 80% by weight, of a compound of the formula

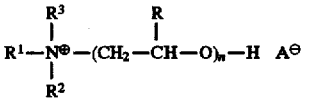

in which $R^1$ and $R^2$ are $C_8$–$C_{20}$-alkyl or $C_8$–$C_{20}$-alkenyl, $R^3$ is $C_1$–$C_4$-alkyl, R is hydrogen or $C_1$–$C_4$-alkyl, n is a number from 1 to 20 and

A is a benzoate or propionate anion, and from 5 to 70% by weight, preferably from 8 to 50% by weight, of a nonionic emulsifier of the formula

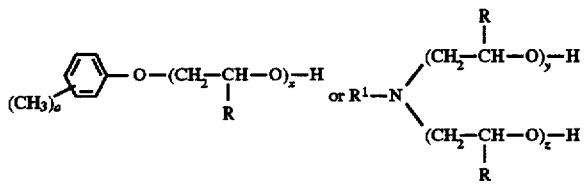

in which a is 1 or 2, x is a number from 1 to 20, preferably 3 to 5, y and z are each numbers from 2 to 20, preferably 2, and the remainder, making up 100% by weight, is water or an organic solvent.

Quaternized esters of saturated or unsaturated fatty acids and alkanol amines are used as softeners in the finishing of textiles (DE-A-40 15 849, EP-A-0 483 195).

It has been found that the quaternary ammonium compounds which are known from the prior art and which are used as car drying agents are only of limited biodegradability. In the context of increased environmental awareness, however, it is precisely the feature of biodegradability which is coming under particular scrutiny.

The object was therefore to find quaternary ammonium compounds which are distinguished by good biodegradability and which, moreover, can be employed in car dry-bright compositions.

The invention provides a car dry-bright composition comprising from 1 to 30% by weight of quaternary ammonium compounds of the formula

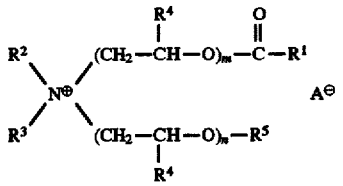

in which $R^1$ is independently at each occurrence $C_6$–$C_{22}$-alkyl or $C_6$–$C_{22}$alkenyl, m and n independently of one another are a number from 1 to 6, $R^2$ is $C_1$–$C_4$-alkyl, $R^4$ is hydrogen or $C_1$–$C_4$-alkyl, $R^5$ is hydrogen or a group of the formula $C(O)R^1$, $R^3$ is $C_1$–$C_4$-alkyl or a group of the formula

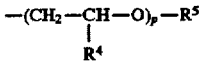

in which $R^4$ and $R^5$ are as defined above and p is a number from 1 to 6, and $A^{\ominus}$ is an anion, and water and, if desired, further auxiliaries corresponding to the balance to 100% by weight.

In the above-defined ammonium compounds, $R^1$ is preferably, independently at each occurrence, $C_8$–$C_{18}$-alkyl or $C_8$–$C_{18}$-alkenyl. Particularly preferred alkyl or alkenyl radicals in this context are those derived from coconut fatty acid, tallow fatty acid, oleic acid, tall oil fatty acid, sperm oil fatty acid, soya oil acid and castor oil acid.

The radical $R^2$ is preferably methyl.

The radical $R^4$ is preferably hydrogen.

m, n and p are preferably numbers from 1 to 4, and with particular preference are the number 1.

Suitable anions are preferably chloride, bromide, iodide, phosphate, methosulfate, ethosulfate and methocarbonate, and also $C_1$–$C_4$ aliphatic carboxylate anions, preferably acetate and propionate, and aromatic carboxylate anions, preferably benzoate and naphthoate.

The quaternary ammonium compounds used in accordance with the invention can be prepared by a process analogous to that described in EP-A-0 438 195 or in DE-A-40 15 849.

The quaternary ammonium compounds are preferably present in the car dry-bright composition in a quantity of from 5 to 15% by weight.

The ammonium compounds employed are mono-, di- and/or tri-fatty acid esters of quaternary alcohol amines. The car dry-bright compositions of the invention contain these esters either in the form of the individual compounds or in the form of their mixtures.

A preferred mixture comprises from 25 to 50% by weight, preferably from 30 to 40% by weight, of the monoester, from 40 to 60% by weight, preferably from 45 to 55% by weight, of the diester, and from 5 to 15% by weight, preferably from 5 to 10% by weight, of the triester.

As far as suitable auxiliaries are concerned, the car dry-bright compositions according to the invention may include nonionic emulsifiers. These include, in particular, $C_8$–$C_{22}$-alkylamino-($C_1$–$C_4$)-alkoxylates and/or $C_8$–$C_{22}$-alkylalkylenediamines. The proportion of nonionic emulsifiers is usually from 2 to 10% by weight, preferably from 2 to 8% by weight, based on the total weight of the car dry-bright composition.

Other suitable auxiliaries are dihydric alcohols, preferably ethylene glycol and propylene glycol. Also suitable are $C_1$–$C_6$-alkyl ethers of dihydric alcohols, preferably butylglycol, and alkoxylated $C_6$–$C_{18}$ alcohols having an average molecular weight $\overline{M}_w$ in the range from 200 to 5000. These further auxiliaries are included in the car dry-bright composition of the invention in proportions of up to 20% by weight, preferably from 2 to 15% by weight, based on the total weight of the composition.

For use in practice, these car dry-bright compositions are prepared simply by mixing the individual components. Using the ratios indicated above, a concentrate is obtained which is additionally diluted with from 150 to 500, preferably 300, times the quantity of water and is sprayed in this form, as final rinsing water, onto the surface of the car in carwash installations. Visual observation of the washed vehicles shows that, following application of the car dry-bright composition according to the invention, the film of water is opened up after less than 10 seconds and the remaining water quickly runs off in the form of drops or is flung off by the use of fans. Subsequently, the surface of the car is dry and bright and free from blotches. A particular advantage of the above-described car dry-bright compositions which should be mentioned is that, in addition to the favorable properties of the known compositions, such as the water film-opening effect, the brightness effect and storage stability, the novel compositions exhibit a markedly increased degree of biodegradability.

PRACTICAL EXAMPLE

A car dry-bright composition is prepared by combining the components listed below in the order given at room temperature. After addition of the water, a clear solution is obtained.

EXAMPLE 1

12% by weight of N,N-di(β-tallowoylethyl)-N-methyl-N-hydroxyethylammonium chloride 10% by weight of butylglycol 5% by weight of oleylamine ethoxylate 73% by weight of water This concentrate is stable on storage in the temperature range between −5° C. and +50° C. and, even after a storage time of weeks under the conditions of a repeated-cycle test (−5° C., +50° C.), displays no tendency toward separation phenomena.

1 g of this formulation is then added continuously to each liter of flushing water in a rapid carwash installation. The washing process includes the washing of the car body, rinsing with fresh water and then a secondary rinse to which the abovementioned formulation was added. Subsequently, for test purposes, a third rinse of fresh water containing no additives was sprayed onto the car body, which was then blown dry, and the result was assessed visually. This assessment found that the rinsing water runs off more quickly and gloss is produced on the surface of the car body. The water film-opening time in the washing installation is 5 seconds.

Equal results are obtained with novel car dry-bright compositions which are made up as follows:

EXAMPLE 2

10% by weight of N,N-di(β-tallowoylethy)-N-methyl-N-hydroxyethylammonium chloride 8% by weight of butylglycol 5% by weight of oleylamine ethoxylate 2% by weight of $C_{12}$/$C_{14}$-alkylpropylenediamine 5% by weight of water Testing for biodegradability:

The biodegradability of the quaternary ammonium compound is determined by a modified Sturm test in accordance with OECD Guideline 301B. In this case, the biological elimination [% DOC] is given as a function of the time [d] (day).

| Test substance: N,N-di(β-tallowoylethyl)-N-methyl-N-hydroxyethylammonium chloride | | |
|---|---|---|
| Concentration: | 20 [mg/l] | 20 mg/l |
| Biodegradation: | | |
| after 6 d | 14% | 20% |
| after 14 d | 41% | 42% |
| after 21 d | 54% | 55% |
| after 28 d | 72% | 72% |

Assessment: readily biodegradable

We claim:

1. An aqueous car dry-bright composition comprising:

a concentrate consisting essentially of:

(a) from 1 to 30% by weight of quaternary ammonium compounds of the formula

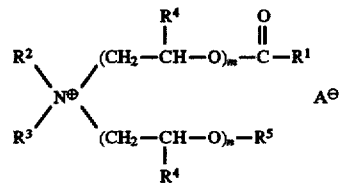

in which $R^1$ is independently at each occurrence $C_6$–$C_{22}$-alkyl or $C_6$–$C_{22}$-alkenyl, m and n independently of one another are a number from 1 to 6, $R^2$ is $C_1$–$C_4$-alkyl, $R^4$ is hydrogen or $C_1$–$C_4$-alkyl, $R^5$ is hydrogen or a group of the formula $C(O)R^1$, $R^3$ is $C_1$–$C_4$alkyl or a group of the formula $$-(CH_2-\underset{\underset{R^4}{|}}{CH}-O)_p-R^5$$

in which $R^4$ and $R^5$ are as defined above and p is a number from 1 to 6, and $A^{\ominus}$ is an anion, (b) from 2 to 10% by weight of a $C_8$–$C_{22}$-alkylamino-($C_1$–$C_4$)-alkoxylate, a $C_8$–$C_{22}$-alkylalkylene diamine, or a mixture thereof, and (c) the butyl ether of ethylene glycol or propylene glycol;

said composition further comprising from 150 to 500 times the quantity of water, based on the weight of said concentrate.

* * * * *